United States Patent [19]

Bowles

[11] 4,349,333

[45] Sep. 14, 1982

[54] HOT ISOSTATIC PRESS WITH RAPID COOLING

[75] Inventor: Arnold G. Bowles, Jenkintown, Pa.

[73] Assignee: Pressure Technology, Inc., Huntingdon Valley, Pa.

[21] Appl. No.: 232,822

[22] Filed: Feb. 9, 1981

[51] Int. Cl.[3] ..... F27B 5/04

[52] U.S. Cl. ..... 432/205; 165/65; 266/254

[58] Field of Search ..... 432/205; 13/31; 165/65; 266/251, 252, 254

[56] References Cited

U.S. PATENT DOCUMENTS

| | | | |
|---|---|---|---|
| 3,470,624 | 10/1969 | Plotkwiak | 165/61 |
| 4,131,419 | 12/1978 | Isaksson | 432/205 |
| 4,217,087 | 8/1980 | Bowles | 425/78 |
| 4,246,957 | 1/1981 | Smith et al. | 432/205 |

*Primary Examiner*—John J. Camby

*Attorney, Agent, or Firm*—John J. Simkanich

[57] ABSTRACT

An apparatus for treating articles by heat and pressure and then cooling by forced circulation may have a pressurized heated chamber for holding such items to be treated, this chamber being positioned within a cooled, pressure sustaining enclosure, a pressure developing mechanism may be positioned at one side of this enclosure and may include a valving function for selectively drawing inert gas into the enclosure and into the heated chamber the heated chamber including a wall having a plurality of openings spaced throughout into the item-holding chamber, a passageway may extend from one end of this item-holding chamber, past the cooled area of the sustaining enclosure and onto the pressure developing mechanism whereby the valving function may be selectively operated allowing the pressure developing mechanism to circulate the gaseous medium within the apparatus more evenly and uniformly over all items held within the chamber, the heating operation of the chamber being selectively disabled during this circulation whereby a rapid and even cooling of the items is effected.

17 Claims, 3 Drawing Figures

HOT ISOSTATIC PRESS WITH RAPID COOLING

BACKGROUND OF THE INVENTION

This invention relates to hot isostatic presses which are used for the treating of articles or items by heat and pressure. Particularly, this invention is directed to an improved hot isostatic press apparatus whereby there is a more even cooling of the plurality of items which are treated at once enabling a more rapid resolution of the cooling cycle operation whereof each and every item can be cooled to the same temperature within the same time period.

Hot isostatic presses are used to treat or produce various metallic, ceramic and similar items by subjecting the items to relatively high pressure while they are in a hot and plastic state. Castings often include small internal voids or shrinking defects.

Apparatus for conducting such heat treatment processes generally include a pressure vessel which contains cooling coils or a cooling jacket on the outside thereof and insulation on the inner walls. Electrical resistance and other heat eminating structure are generally used to heat a treatment chamber within the pressure vessel.

Typically, a compressor located externally to the pressure chamber is utilized to feed an inert gas under high pressure into the pressure vessel and thereby the treatment chamber. Gas pressures can range from 1000 to 30,000 p.s.i. and above, while temperatures developed by the heating elements can range from 500 to 2000° C.

Greene, U.S. Pat. No. 3,168,607, teaches a method and apparatus for heat treating articles. Greene discloses a cylindrical or oblong pressure vessel having a distinct elongate treatment area within and separate heat supply and cooling supply chambers. A positive pressure or, alternately, a partial vacuum is developed by an apparatus external to the pressure vessel, while a impeller type circulating fan situated at one end of the Greene vessel circulates either heating air or cooling air, depending upon the position of a plate valve, into the heat treatment area from one end.

Isaksson, U.S. Pat. No. 4,131,419, like Greene, discloses a cylindrically-shaped pressure treatment vessel. Here gases may be circulated from the heated inner space past and outer walls and through conduits 19,21 by operation of a valve 20 and in another embodiment by operation of valve 20 and pump 26. Isaksson has his cooled gases enter only at the bottom of his inner treatment space at its periphery and exit at the top at its periphery.

Smith, et al, U.S. Pat. No. 4,235,592, like Greene and Isaksson, discloses a cylindrically-shaped pressure treatment vessel. Smith, et al. cause a forced circulation of either hot gases, FIG. 3, or cooled gases, FIG. 4, similar to Greene. Smith, et al., however, utilize a slide plate diverter type valve, to increase the path of the gas flow past the cooled walls. Gas circulation enters the bottom of the treatment chamber and exits at the top, only.

Bowles, U.S. Pat. No. 4,217,087 teaches an isostatic apparatus for the treatment of articles with great heat and great pressure. Bowles teaches an oblong shaped or cylindrical-shaped pressure vessel having a cylindrically shaped heat treatment area within. Pressures are developed by an external structure to the pressure vessel and by expansion upon heating. A pressure operated valve at one end of the cylindrical treatment chamber is opened to allow a circulation of the heated inert gas past the outer cold vessel through natural convection. This Bowles pressure vessel is positioned in an upright manner with the cylindrical heat treating area standing upright, the cooler gas tending to travel downwardly past the cold vessel wall and to enter the heat treatment area through the open valve to fill the void left by the rising hot gas within and forcing the hotter gas out of the top of the cylindrical treatment area.

An object of the present invention is to provide a pressurized heat treating structure for articles, the structure having an inert gas circulating apparatus selectively operated for circulating the pressurized gas through the treatment area for cooling.

A second object of this invention is to provide such a heat treatment structure with more even flow of the cooling inert gas during a cooling portion of the treatment cycle.

A further object of this invention is to provide the heat treatment structure with a double walled chamber, establishing a passageway for the flow of the inert gas, and an inlet from the pressure producing structure and incorporating a diffusing function for a more even flow of cooling circulation over each and every one of the articles held within.

SUMMARY OF THE INVENTION

The objects of this invention are realized in a hot isostatic press which effects a more uniform cooling operation upon each of the objects or items held within the treatment area of the press following a temperature and pressure operation thereby providing a shorter treatment cycle wherein all of the objects are more quickly and evenly cooled to a desired temperature level.

A pressure vessel may be utilized having removable end portions incorporating cooling structure throughout. Typically this pressure vessel is cylindrically shaped having top and bottom closures or inserts. Insulation may be provided at the inner walls of this pressure vessel and spaced slightly inwardly therefrom to define a passageway for inert gas held within the pressure vessel, which gas may be cooled by the combination of the auxiliary cooling of the pressure vessel wall and the insulation.

A group of electrical resistance heaters are provided. These are positioned within the pressure vessel, surrounded by the insulation. An item treatment area may be situated within the heat generating region. This treatment area may be surrounded by a double jacketed wall structure having holes through the inner wall thereof as a diffuser function and having the two walls spaced slightly apart therefrom to form a passageway.

Inert gas circulation may be provided of this passageway between the walls by a pump type circulation producing structure having its discharge side connected to the space between the two chamber walls.

A pressure actuated valve may be situated adjacent to the inlet side of the circulator pump for operating in conjunction with external pressure for circulating the inert gas through the double walled chamber diffuser and about an item held within the treatment area thereby evenly cooling such item with cooled gas having first been recirculated past the cooled surface of the pressure vessel outer wall.

Another passageway may access the circulation passageways and thereby the entire apparatus. This passageway is used for filling the entire apparatus with inert gas under pressure.

DESCRIPTION OF THE DRAWINGS

The advantages, features and operation of this invention will be better understood from a reading of the following detailed description of the invention in conjunction with the attached drawings in which like numerals refer to like elements and in which.

DETAILED DESCRIPTION OF THE INVENTION

Figure 1:
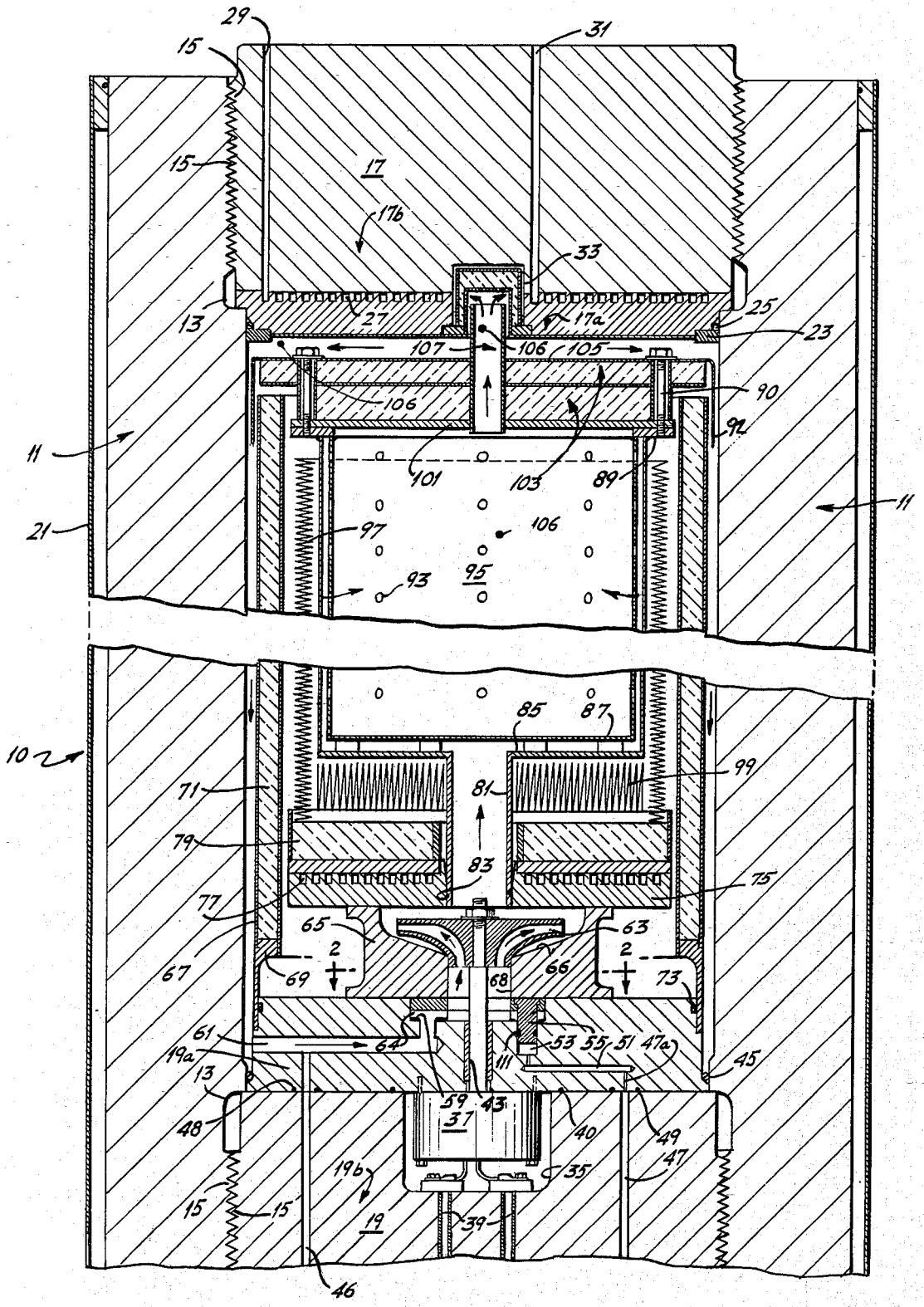
FIG. 1 is a sectional view taken along a longitudinal axis of a hot isostatic press in accordance with this invention.

A hot isostatic press 10, FIG. 1, in accordance with this invention, includes a cylindrically shaped pressure vessel 11 which is intended to stand upight having an open top and bottom ends thereof. This pressure vessel 11 has a cylindrical wall of high strength steel or other material of sufficient thickness and strength of withstand pressures up to 15,000 p.s.i. and above. The side wall of this pressure vessel is of a uniform thickness through the middle portion thereof with a slightly smaller thickness at the ends creating a slightly longer inside diameter which is threaded at 15. A concave shoulder 13 is created at the transition from smaller to larger inside diameter at each end. The slightly narrower wall sections at either end are threaded 15 for mating with a respective top threaded closure 17 and bottom threaded closure 19 having correspondingly mating thread pitches 15. The outside wall of the pressure vessel 11 is water jacketed by means of metal jacket 21 through which cooling water or other fluid is circulated for cooling the wall 11 of the pressure vessel.

The top threaded closure 17 is cylindrically shaped and includes a separate inner bearing plate **17*a* and an outer sealing cap 17*b* which carries the mating threads 15. The bearing plate 17*a* is assembled to the sealing cap 17*b* by screws or other means before assembly into the vessel 11. The bearing plate portion 17*a* seats against an annular support ring 23 held in position near the top of the thicker section of the pressure vessel wall 11. The top closure bearing plate 17*a* contains a plurality of machined offset surfaces including an inwardly tapering face on the periphery of its downwardly facing side for seating against, among others, the support ring 23 and the concave shoulder 13 of the pressure wall. A further offset surface provides a space for a first pressure sealing O-ring 25 which seals the space between the top closure bearing plate 17*a* and the pressure vessel wall 11. The support ring 23 is used to retain the high pressure seal arrangement including the O-ring 25 and an anti-extension ring. This anti-extension ring, which is of standard design, is positioned directly over the O-ring 25. As the vessel 11 expands with increases in heat and pressure, the anti-extension ring is forced to expand, sliding up the tapered face of the bearing plate 17*a***.

The top surface of the top closure bearing plate **17*a* portion of the closure 17 includes a cooling fluid channel 27 which when the threaded top closure cap 17*b* is assembled against the bearing plate 17*a* forms a continuous cooling fluid passageway. This channel 27 can meander over the surface of the bearing plate 17*a* in any desired fashion. An obvious choice for this passageway is a spiral configuration as shown in FIG. 1. First and second vertical passageways 29, 31 extend through the threaded top closure cap 17*b* for providing an inlet and outlet to the bearing plate cooling passageway 27**.

The top closure bearing plate **17*a* contains a step-bore (having two distinct diameters) in the concentric center thereof. The threaded top closure cap 17*b* contains a circular hole in line with the bearing plate step-bore of similar dimensions. Fitted neatly and tightly into the bearing plate 17*a* and threaded top closure cap 17*b* center bores is a cap-shaped insulation thimble 33. The insulation from which this thimble 33 is made is of a type used in ceramic furnaces or other such uses where temperatures of 500 to 2000° C. are commonplace and pressures of 15,000 p.s.i. or above exist. The thimble 33** provides a space for an outlet pipe to extend upwardly thereinto to provide a heat lock or seal against heat convection currents as will be further discussed below.

The bottom closure 19, like the top closure 17 is made in two portions. The first portion is the bottom closure bearing plate **19*a* while the second portion is the threaded bottom closure cap 19*b*. Threaded bottom closure cap 19*b* contains a hollowed out cavity 35 in which a variable speed electric motor 37 is mounted. This electric motor 37 is externally connected to a electric supply via a pair of electrical conductors 39 which extend through the threaded bottom closure 19*b*. A pressure seal is established at these electrical conductors 39**.

A second O-ring 40 is positioned on the interfacing surface between the threaded bottom closure cap **19*b* and the bottom bearing plate 19*a* to annularly extend about the motor cavity 35**.

Motor shaft 41 extends through the bottom bearing plate **19*a* and runs against a cylindrical sleeve bearing 43 extending through the bottom bearing plate 19*a***.

A third O-ring 45 is positioned about the circumference of the bottom bearing plate **19*a* to seal against the pressure vessel wall 11. This O-ring 45 is positioned against a machined offset surface on the bottom bearing plate 19*a*. A gas passageway 47 extends vertically through the bottom threaded closure cap 19*b*. A fourth O-ring 49 is positioned at the mating surface between the bottom threaded closure cap 19*b* and the bottom bearing plate 19*a* to extend annularly about the gas passageway 47. This gas passageway 47 mates with a smaller extension passageway 47*a* in the bottom bearing plate 19*a* to join with a control passageway 51 running horizontally across one side of the bottom bearing plate 19*a*. The control passageway 51 has a reduced vertically running section which mates with a cylindrical hole 53 in which an actuating piston 55 operates. The passageways 47, 47*a*, 51 and hole 53 provide a means for pneumatic control of a valving disc 57**.

The actuating piston 55 is in juxtaposed connection with a valving disc 57 which disc 57 is raised or lowered off of a copper circular gasket 59. The disc 57 operates in a cylindrical cavity 60 which opens onto the face of the bottom bearing plate **19*a* away from the bottom closure cap 19*b*. The copper gasket 59 is seated in the bottom of the cylindrical cavity and has a first opening through which the piston 55** operates.

Piston 55 carries an annular sealing ring on its body for riding against the cylindrical hole 53.

The copper gasket 59 also has an opening 64 for opening into an inlet passageway 61 which passageway 61 accesses the area inside of the pressure vessel wall 11.

A gas inlet-outlet passageway 46 extends through the bottom threaded closure cap 19*b* and the bottom bearing plate 19*a* to access the inlet passage 61. This gas inlet-outlet passageway 46 is used to pressurize or depressurize the interior of the pressure vessel 11 from an external connection. An O-ring 48 seals about this passageway 45 at the mating surface of the bottom closure cap 19*b* and bottom bearing plate 19*a*.

An impeller 63 pump is mounted on the end of the motor shaft 41. The impeller 63 operates in a dish shaped cavity 66 cut into a cylindrically shaped pedestal 65 which is positioned to bear upon the bottom bearing plate 19*a* about the cylindrical cavity 60. The pedestal 65 has its top and bottom surfaces extending beyond its body to form top and bottom flanges. The dish shaped cavity 66 of the pedestal 65 extends about one-half of the pedestal height. A cylindrical bore 68 extends vertically through the center of the pedestal 65 from the bottom of the dish shaped cavity 66 to the bottom face of the pedestal to connect to the cylindrical cavity 60 of the bottom bearing plate 19*a*.

A support sleeve 67 extends about a hollow insulation cylinder 71 and upwardly from the circumferal periphery of the bottom bearing plate 19*a*. A cylindrical pedestal 69 extends upwardly from the periphery of the bottom bearing plate 19*a* and supports the cylindrically shaped insulating material 71. A fifth O-ring 73 seals the space between this cylindrical pedestal 69 and the bottom bearing plate 19*a*.

A cylindrically shaped hearth base plate 75 having cooling passageways 77 therein is positioned to seat upon the top of the pedestal 65 and centered thereon. A disc of hearth insulation 79 is mounted above the hearth base plate 75. Both the hearth base plate 75 and the hearth insulation 79 have a center opening through which an inlet pipe 81 extends. This inlet pipe 81 carries away the discharge from the impeller 63 and includes a sixth O-ring 83 sealing the outside of the inlet pipe and the hearth base plate 75.

A closed and cylindrically shaped wall 85 forms the outer wall of a double walled chamber. This double wall chamber has in inner wall 87 spaced inwardly from the outer wall 85 to allow the passage of gas discharge from the impeller 63, through the inlet pipe 81 and between the double walls 85, 87. The inner wall 87 of this chamber is supported in a fixed relation to the outer wall 85 by their both being welded to a circular or annular ring plate 89 at their top or open ends.

This annular ring plate 89 facilitates the mounting of additional structure by the use of a plurality of clamping bolts 90 through the flange formed by the extension of this ring plate 89 beyond the welds of the inner and outer cylindrical walls 87, 85. The inner wall 87 is therefore suspended by the outer wall 85 by operation of the connection to the ring plate 89 structure. A plurality of holes 93 extend throughout the inner wall 87 which permits the entrance into the inner heat treatment space 95 of circulated cooled gas uniformly throughout the entire space 95. This circulation is carried between the two walls 85, 87 of that chamber. The size and spacing of these holes 93 tends to create a diffuser effect whereof they are very small and evenly spaced enabling a uniform flow of the gas throughout the entire length of the inner chambered space 95. The holes 93 size and pattern may be adjusted to adjust gas circulation flow as needed.

Surrounding the outside of the outer chamber wall 87 on its sides and its bottom are side heaters 97 and a hearth heater 99, respectively. These heaters 97, 99 heat the double walled chamber 85, 87 and the heat treatment space 95 within. The insulation 71 operates to protect the pressure vessel walls 11 and base plate 75 and associated structure from the heat developed by the heaters 97, 99. The side heaters 97 visible in FIG. 1 are representative of a plurality of such heaters distributed around the chamber.

A removable cover to the heat treatment space 95 includes a circular sealing plate 101, circular insulation discs 103 and top plate structure 105, which forms an integral structure, are clamped to the support ring 89 via the plurality of bolts 90 to seal the inner heat treatment chamber 95. An outlet pipe 107 extends through the center of this removable cover (plate 101, insulation 103, top plate 105) to connect to the top or outlet end, opposite the inlet pipe end, of the heat treatment chamber 95 and to carry the gases there within outwardly and upwardly and into and around within the insulation thimble 33 and then out of the thimble 33 to circulate across the top plate 105 and down along the pressure vessel outer wall 11 on the outside of the insulation 71.

A skirt 92 extends downwardly from the top surface of the top plate 105 in the middle of the space between the insulation 71 and the vessel wall 11 to a point below a gap between the top edge of the insulation 71 and the top plate insulation 103. This gap has been left in the structure for expansion and contraction. However, it also allows for a leakage of heat from the inner area of the heaters 97, 99. The downward extension of the skirt provides a heat trap and retards and convection currents carrying heat away from the heaters 97, 99 toward the cooler outer portion of the apparatus.

By having the outlet pipe 107 extend beyond and above the passageway space between the top bearing plate 17*a* and the top plate 105 and into the concave cylindrical inner space of the thimble 33 another heat trap is created. Cooler gases which will exist within the space between the cooled top bearing plate 17*a* and the insulated top plate 105 will not be able to back down into the treatment area 95 during the heating cycle. Any hot gases rising from the treatment area 95 will be caught by the trap created by the inverted cylindrical cup-shape of the thimble 33 and the outlet pipe 102 opening extended well into the thimble 33.

Typically, items to be heat treated are loaded into the isostatic press through the top, the top closure portions 17*a* and 17*b* having been removed as a unit as well as the top 101, 103, 105 to the heat treatment chamber. When they have been positioned within the chamber 95, the top 101, 103, 105 is reinstalled and the top closure 17 (17*a*, 17*b*) is assembled on the pressure vessel walls 11. Inert gas is introduced into the vessel through the gas passageway 46 until a desired pressure is attained within the press 10. Once the desired pressure is attained, or concurrently to build up the pressure, the heaters 97, 99 operate to raise the temperature within the heat treatment area 95 to the desired operating temperature and increase the pressure. The operating temperature and pressure are maintained for a desired period.

When the cooling cycle is to begin, a control valve is operated to provide a pressure through the control passageways 47, 47*a*, 51 raising the actuating piston 55 and raising the valving disc 57 to allow the flow of gas through the inlet passageway 61 to the inlet side of the impellor 63. The control passageway 47 et al equalizes or unequalizes the pressures on the actuating piston 55. When the pressure in the hole 53 is equal to the pressure on the piston 55, springs 109 lift the plate 57 up to free the openings 64. The variable speed motor 37 operates to circulate gas through the inlet pipe 61, through the pump impeller, and into the heat treatment area via the diffuser holes 93. Hot gas is then discharged or evacuated through the outlet pipe 107 and then passes adjacent and in contact with the cooled top bearing plate 17*a*, and then the cooled pressure vessel wall 11 and cooled bottom bearing plate 19*a*, all of which are on the outside of their respective insulation, 103, 77, 79, rapidly cooling the gas before it it discharged into the heat treatment area 95 in a much cooled state. The cooperation of the impellor discharge at a pressure and the diffuser operation of the holes 93 in the inner chamber wall 87 allows a more even distribution of cool gases simultaneously over all of the items held within the heat treatment area 95. Items held at the bottom of the heat treatment area 95 closest to the inlet pipe 81 are not given preferential treatment and do not get substantially more cooling or at a faster rate of cooling than articles held near the outlet pipe 107 end of the heat treatment area 95. In this manner a more uniform heat treatment of all items within the heat treatment area 95 is effected and assured and the total cooling cycle time for all items held.

Thermocouples 106 are located in the heat treatment area 95 on the inner wall chamber 87, on the outlet pipe 107 and in the passageway formed between the top plate 105 and the top closure bearing plate 17*a* for supplying operational information to a separate and disparate controller which can monitor and control the operation of the heaters 97, 99, the circulation impellor 63 (motor 37) and the control pressure to the valve pistons 55.

Figure 2:
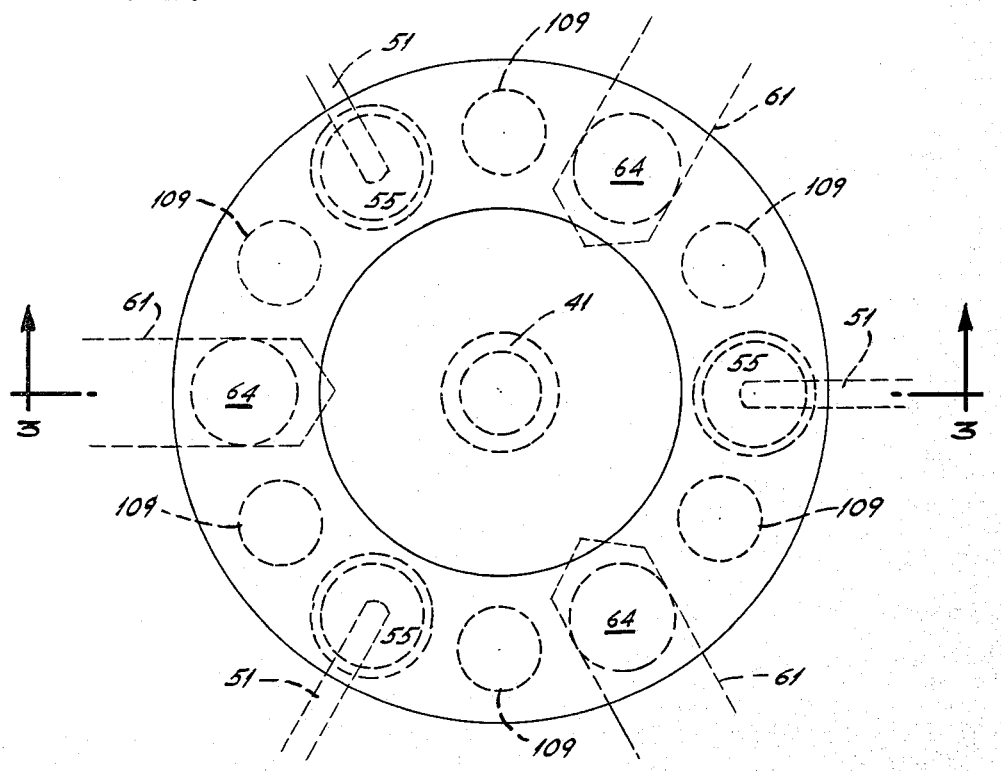
FIG. 2 is a sectional view taken along the line 2—2 of FIG. 1 which shows the plan elevation view of the circulation valve of FIG. 1.
Figure 3:
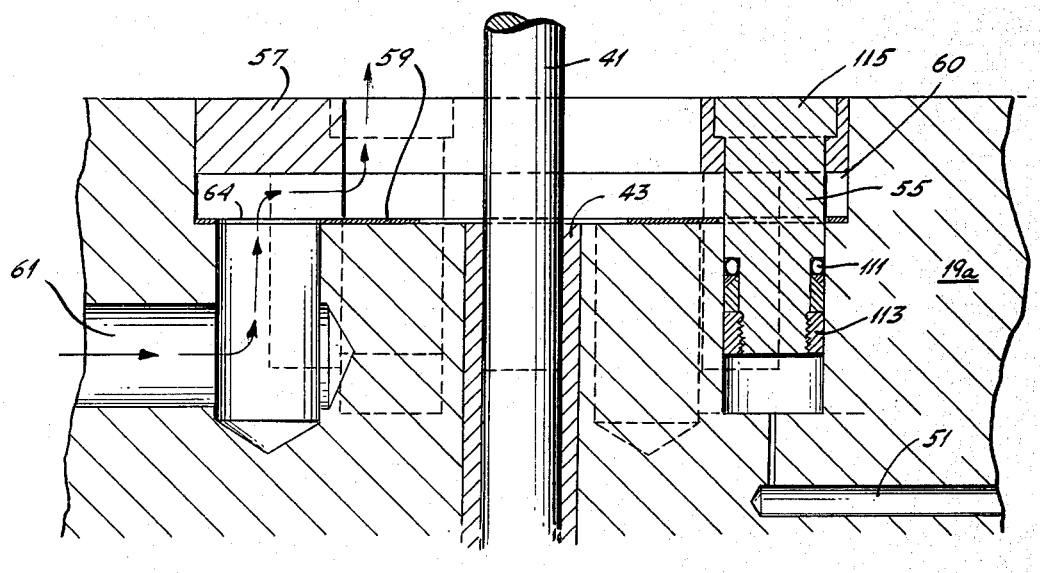
FIG. 3 is an enlarged view of the pressure operated recirculating valve of FIG. 1 taken along the longitudinal axis 3—3 as seen in FIG. 2.

The gating disc 57 can be seen in a plan elevation view in FIG. 2. The control passageway 51 may actually be a plurality of control passageways, such as three, evenly spaced about the valving disc 57. Each such control passageway may operate an individual actuating piston 55. As shown in FIG. 3, three evenly spaced actuating pistons 55 operate to evenly and uniformly raise or allow lowering of the valving disc 57. Similarly the inlet passageway 61 may be a plurality, such as three, passageways. Spring biasing can be incorporated to bias the valving disc to the open or the closed position. Six such springs 109 are utilized as shown in FIG. 2 and are positioned between inlet passageways 61 and control passageways 51.

FIG. 3 shows the detailed structure of the circulation valve which is formed as part of the bottom bearing plate 19*a* and extends about the impellor shaft 41 and sleeve bearing 43. Here one of the control passageways 51 is readily shown to feed into the cylindrical opening 60 for driving the actuating piston 55. The actuating piston 55 includes the sealing O-ring 111 and an anti-extension sleeve assembly 113. The actuating piston 55 has a protruding head flange 115 for mating with the valving disc 57. When the control pressure in the control passageway 51 is less than the pressure above the actuating piston 55 the piston 55 draws down on the disc 57 and seats the disc 57 against the copper gasket 59 sealing off the plurality of inlet passageways 61.

As an alternative to the control valve structure of FIG. 3 and the impellor 63, a positive displacement pump can be positioned between the inlet passageway 61 and the inlet pipe 81 leading to the heat treatment area 95 to be driven by the motor shaft 41. This pump would automatically operate in its normal operating manner to incorporate both the pumping and valving functions of this above-described structure.

Many changes could be made in the above-described isostatic press structure and operation to generate alternate embodiments of this invention without departing from the intent or scope thereof. It is intended that all matter contained in the above description shall be interpreted as illustrative and not be taken in the limiting sense.

I claim:

1. An apparatus for the pressure heat treating and annealing of objects including the controlled uniform and rapid cooling thereof, comprising:

means for containing at least one object for treatment, said containing means including a cylindrical wall surrounding said object having a plurality of holes therein;

means for surrounding said containing means for heating said object contained therewithin;

means surrounding said heating means for holding a gas pressure established therewithin;

means within said pressure holding means and spaced therefrom for insulating said pressure holding means from said heating means;

means for evacuating said gas from said containing means, said evacuating means being at the center and top of said containing means; and means for circulating said gas adjacent said pressure holding means surfaces for cooling said circulated gas thereby and for passing said cooled gas into said containing means through said cylindrical wall plurality of holes thereby causing a forced circulation uniformly about the inside of said cylinder.

2. The apparatus of claim 1 also including heat trap means associated with said evacuating means and positioned adjacent thereto, for inhibiting heat leakage flow from said containing means, said heat trap means being smaller than said cylindrical wall diameter.

3. An apparatus for the pressure heat treating and annealing of objects including the controlled uniform and rapid cooling thereof, comprising:

means for containing at least one object for treatment;

means surrounding said containing means for heating said object contained therewithin;

means surrounding said heating means for holding a gas pressure established therewithin;

means within said pressure holding means and spaced therefrom for insulating said pressure holding means from said heating means, said insulating means including an insulation cylinder spaced away from said heating means and said pressure holding means, a top plate spaced away from and above said insulation cylinder and a cylindrical skirt extending downwardly about the edge of said top plate in the space between said pressure holding means and said insulation cylinder, spaced away both therefrom and extending downwardly beyond the top edge of said insulation cylinder; and means for cooling said object contained therewithin by causing a forced circulation uniformly about said object.

4. The apparatus of claim 2 wherein said gas pressure holding means is a pressure vessel; wherein said means for containing is a treatment chamber having an inner wall being said cylindrical wall with said plurality of holes and an outer cylindrical wall spaced from said upper wall.

5. The apparatus of claim 4 wherein said means for evacuating said gas includes an outlet pipe extending upwardly from the center and top of said treatment chamber, said outlet pipe being smaller in diameter than said inner wall cylindrical diameter; wherein said gas circulating means includes a circulation passageway from said outlet pipe extending past the inside walls of said pressure vessel, a motor driven gas pump connected to evacuate said circulation passageway said pump discharge side feeding said space between said treatment chamber inner and outer walls.

6. The apparatus of claim 5 wherein said heat trap means includes a cylindrically shaped inverted thimble extending downwardly about and over said outlet pipe end thereby establishing a cup-shaped heat trap spaced therefrom and allowing a passageway connection to said circulation passageway; and also including insulation between said heating means and said pressure vessel inside walls, said insulation being spaced from said inside pressure vessel walls to form a portion of said circulation passageway.

7. An apparatus for the pressure heat treating and annealing of objects including the controlled uniform and rapid cooling thereof, comprising:

a pressure vessel, having a fluid cooling means portion thereof;

a treatment chamber located within said pressure vessel, said chamber including a diffuser having an inner cylindrical shaped wall having a plurality of holes therein, and an outer cylindrical wall spaced from said inner wall to form a diffuser passageway therebetween;

an outlet pipe extending from said treatment chamber;

a circulation passageway from said outlet pipe extending past the inside walls of said pressure vessel;

a cylindrically shaped thimble extending about and over said outlet pipe thereby establishing a cup-shaped trap over said outlet pipe;

means surrounding said treatment chamber for heating said treatment chamber;

insulation between said heating means and said pressure vessel inside walls, said insulation being spaced from said inside pressure vessel walls, said insulation being spaced from said inside pressure vessel walls to form a portion of said circulation passageway;

a motor driven gas pump connected to evacuate said circulation passageway from said outlet pipe; and an inlet pipe connected between said diffuser passageway and said pump discharge.

8. The apparatus of claim 7 wherein said pump includes an impeller and a motor in driven connection with said impeller.

9. The apparatus of claim 8 wherein said treatment chamber also includes a removable cover connected to said inner and outer walls.

10. The apparatus of claim 9 wherein said circulation passageway is formed by a continuous open pathway between said removable cover and the top inner wall of said pressure vessel, said space between said insulation and said pressure vessel side walls and a separate passageway through a portion of the bottom wall of said pressure vessel connecting said impeller intake.

11. The apparatus of claim 10 also including a valve in said bottom wall passageway.

12. The apparatus of claim 11 wherein said valve is selectively operable.

13. The apparatus of claim 12 also including pneumatic control passageways in said bottom wall of said pressure vessel operably affecting said valve.

14. The apparatus of claim 13 wherein said pressure vessel is cylindrically shaped having removable top and bottom closures and wherein said fluid cooling means includes a cooling jacket surrounding said cylindrical vessel side walls and cooling passageways through said removable top and bottom closures.

15. The apparatus of claim 14 wherein said removable chamber top is insulated and bolted to said inner and outer walls.

16. The apparatus of claim 15 also including a skirt extending downwardly from said removable chamber top about the periphery thereof and into said passageway next to said pressure vessel side walls and beyond the top of said insulation.

17. The apparatus of claim 16 wherein said valve includes a disc operating in a cylindrical cavity in said pressure vessel bottom closure, said circulation passageway through the portion of the bottom wall of said pressure vessel being a passageway connecting said cylindrical cavity in said pressure vessel bottom closure with the passageway created by the space between said insulation and said pressure vessel side walls, said disc operating to close and open said circulation passageway at said cylindrical cavity.

* * * * *

UNITED STATES PATENT AND TRADEMARK OFFICE

CERTIFICATE OF CORRECTION

PATENT NO. : 4,349,333

DATED : September 14, 1982

INVENTOR(S) : Arnold G. Bowles

It is certified that error appears in the above-identified patent and that said Letters Patent are hereby corrected as shown below:

Col. 1, line 47, "and" (first occurrence) should be "the"

Col. 3, line 27, "of" (second occurrence) should be "to"

Col. 9, line 2, "upper" should be "inner"

Signed and Sealed this

*First* Day of *March 1983*

[SEAL]

*Attest:*

GERALD J. MOSSINGHOFF

*Attesting Officer*

*Commissioner of Patents and Trademarks*